US007805779B2

(12) United States Patent
Esson

(10) Patent No.: US 7,805,779 B2
(45) Date of Patent: Oct. 5, 2010

(54) APPARATUS AND METHODS RELATING TO A POOL NET

(75) Inventor: Blair Robert Esson, Houston, TX (US)

(73) Assignee: Katchakid Inc., Houston, TX (US)

( * ) Notice: Subject to any disclaimer, the term of this patent is extended or adjusted under 35 U.S.C. 154(b) by 1167 days.

(21) Appl. No.: 11/420,627

(22) Filed: May 26, 2006

(65) Prior Publication Data

US 2006/0205296 A1 Sep. 14, 2006

Related U.S. Application Data

(63) Continuation-in-part of application No. 10/915,969, filed on Aug. 11, 2004, now abandoned.

(51) Int. Cl.
*E04H 4/00* (2006.01)

(52) U.S. Cl. ..... 4/502; 4/498; 242/919; 242/225

(58) Field of Classification Search ..... 4/502; 242/919, 419.8, 225
See application file for complete search history.

(56) References Cited

U.S. PATENT DOCUMENTS

| | | | | |
|---|---|---|---|---|
| 3,662,131 | A | 5/1972 | Leistiko | |
| 4,402,305 | A * | 9/1983 | Kremen | 126/564 |
| 5,108,225 | A * | 4/1992 | Neal | 405/53 |
| 5,162,777 | A | 11/1992 | Kolbatz | |
| 5,517,174 | A | 5/1996 | Barrows | |
| 5,790,024 | A | 8/1998 | Ripingill, Jr. et al. | |
| 6,026,522 | A * | 2/2000 | Last | 4/502 |
| 6,157,304 | A | 12/2000 | Bennett et al. | |
| 6,389,757 | B1 * | 5/2002 | DeGarie | 52/63 |
| 6,647,561 | B2 * | 11/2003 | Walton et al. | 4/502 |
| 2001/0023506 | A1 * | 9/2001 | Mathis et al. | 4/502 |

FOREIGN PATENT DOCUMENTS

| | | |
|---|---|---|
| EP | 0984117 | 3/2000 |
| JP | 02003199479 | 7/2003 |

* cited by examiner

*Primary Examiner*—Gregory L Huson
*Assistant Examiner*—Karen Younkins
(74) *Attorney, Agent, or Firm*—Patterson & Sheridan, L.L.P.

(57) ABSTRACT

The present invention generally relates to an apparatus and a method for tensioning a safety net on a swimming pool. In one aspect, a tension apparatus for use with a pool net is provided. The apparatus includes a housing and a selectively engagable gear arrangement disposed in the housing. The apparatus further includes a rotatable member for supplying rotational energy to the gear arrangement and a spool member operatively attached to the gear arrangement. Additionally, the apparatus includes a cable at least partially wrapped around the spool member, wherein the cable includes a connector configured to connect to the pool net. In another aspect, a method for tensioning a pool net is provided. In yet another aspect, an apparatus for use in tensioning a net is provided.

14 Claims, 3 Drawing Sheets

APPARATUS AND METHODS RELATING TO A POOL NET

CROSS-REFERENCE TO RELATED APPLICATIONS

This application is a continuation-in-part of U.S. patent application Ser. No. 10/915,969, filed on Aug. 11, 2004 now abandoned, which application is herein incorporated by reference in its entirety.

BACKGROUND OF THE INVENTION

1. Field of the Invention

The present invention relates to a swimming pool. More specifically, the invention relates to an apparatus and a method for tensioning a safety net on a swimming pool.

2. Description of the Related Art

A swimming pool typically has some form of a cover when the pool is not in use. There are several different types of covers. One type of cover is a summer cover. The summer cover is generally used to maintain the temperature of the water in the pool. The summer cover may be constructed from plastic film comprising air bubbles or foam. Typically, the summer cover floats on top of the water. Another type of cover is called a winter cover. The winter cover is used to protect the pool from leaves and other items that may fall into the pool during winter months. The winter cover is made from a cloth or a plastic. The edge of the winter cover is attached to the perimeter of the pool by a plurality of fasteners. The winter cover typically does not contact the water in the pool.

Another type of a cover is a pool net. Typically, the net is sized for a particular pool. The net is installed on the pool by anchoring the net around the perimeter of the pool by utilizing a fastener arrangement. The net is generally made of a mesh arrangement that includes a plurality of openings that are small enough to keep the head of an infant or a small child from fitting through the net, but large enough to discourage the infant child from trying to walk across the net. After the net is anchored around the perimeter of the pool, a portion of the net is tightened to create a tension in the net. Generally, the net is tightened to a point where a child or another object of similar weight will be suspended on the surface of the net above the water. However, sometimes it is difficult to tension the net effectively. Therefore, there is a need for a method and an apparatus that is capable of tensioning the net effectively.

SUMMARY OF THE INVENTION

The present invention generally relates to an apparatus and a method for tensioning a safety net on a swimming pool. In one aspect, a tension apparatus for use with a pool net is provided. The apparatus includes a housing and a selectively engagable gear arrangement disposed in the housing. The apparatus further includes a rotatable member for supplying rotational energy to the gear arrangement and a spool member operatively attached to the gear arrangement. Additionally, the apparatus includes a cable at least partially wrapped around the spool member, wherein the cable includes a connector configured to connect to the pool net.

In another aspect, a method for tensioning a pool net is provided. The method includes attaching the pool net to a perimeter of a pool. The method further includes positioning a tension apparatus proximate the pool net and attaching a cable in the tension apparatus to a portion of the pool net. The method also includes tensioning the pool net by supplying rotational energy to the tension apparatus and causing the cable and the pool net to move toward the tension apparatus. Additionally, the method includes securing the portion of the pool net to an anchor member.

In yet another aspect, an apparatus for use in tensioning a net is provided. The apparatus includes a housing and a selectively engagable spool arrangement disposed in the housing. The apparatus further includes a lever member for supplying rotational energy to the spool arrangement. Additionally, the apparatus includes a cable at least partially wrapped around the spool member, wherein the cable includes a connector configured to connect to the pool net.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and a method for tensioning a safety net on a swimming pool. It should be noted that the apparatus and the method of the present invention is not limited to swimming pools. Rather, the invention is equally applicable to water reservoirs, ponds, or any other liquid containers that use a safety net. It should be further noted that the invention may be used in conjunction with a surrounding pool fence. To better understand the novelty of the apparatus of the present invention and the methods of use thereof, reference is hereafter made to the accompanying drawings.

Figure 1:
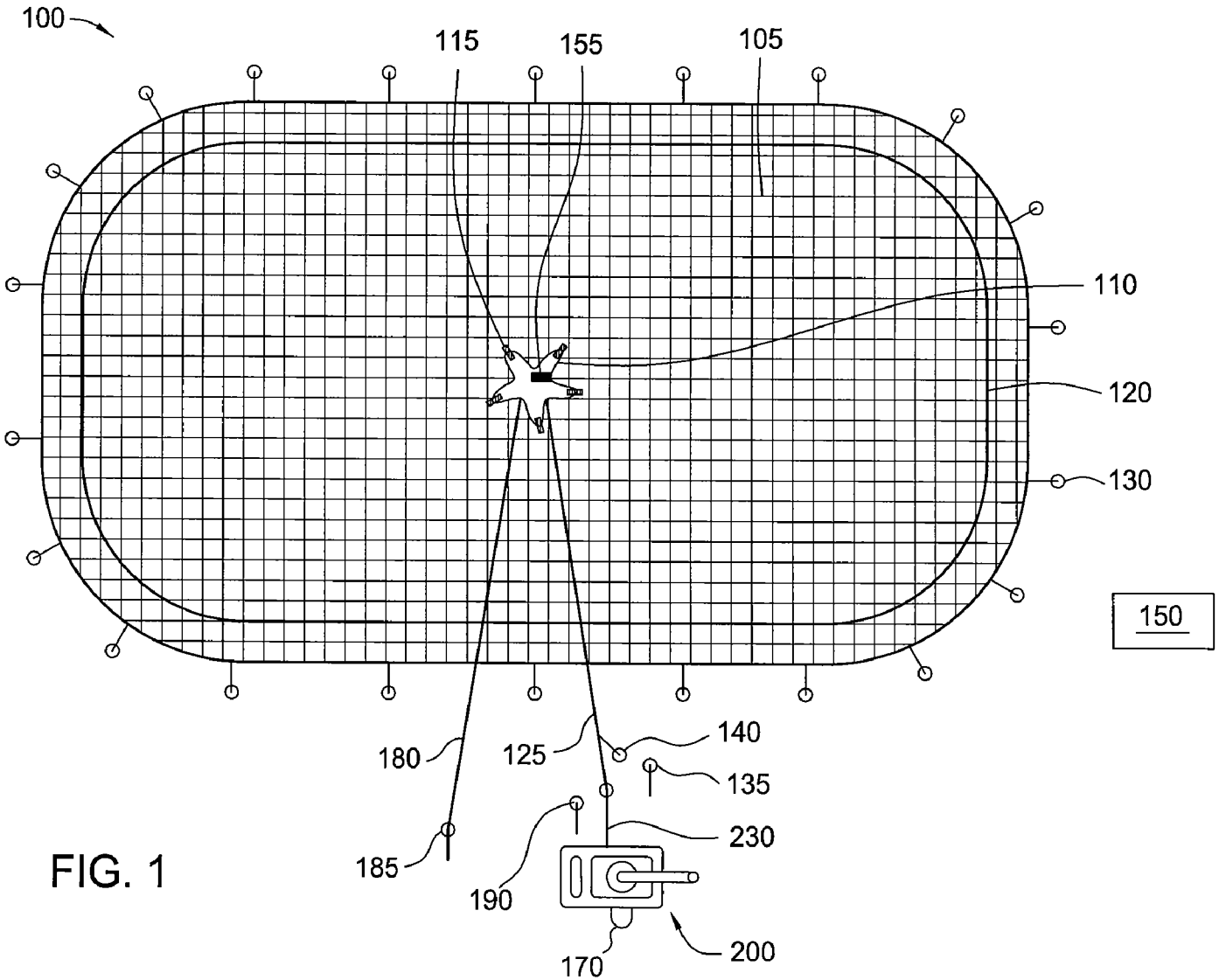
FIG. 1 illustrates a pool net system and a tension apparatus in accordance with the present invention.

FIG. 1 illustrates a pool net system 100 and a tension apparatus 200 in accordance with the present invention. The system 100 includes a net 105 constructed from a high density polyethylene braid or a similar material capable of being held in tension. Proximate the middle of the net 105 is a central tensioning system 110 that includes a plurality of pulleys 115 arranged in a substantially circular fashion. The circular shape formed between the pulleys 115 can be enlarged or reduced in size to control the tensioning of the net 105. As shown in FIG. 1, the central tensioning system 110 further includes a tension cable 125 and a support cable 180.

The system 100 further includes a plurality of anchor members 130 disposed around the perimeter of a pool 120. The anchor members 130 are used to attach the net 105 to the edge of the pool 120. The system 100 also includes a support anchor 185 to secure an end of the support cable 180 and a tension anchor 190 to secure an end of the tension cable 125. The system 100 may further include a lock anchor 135 for locking the tension cable 125 in place after the central tensioning system 110 has been employed.

During a net tensioning operation, the net 105 is secured to the perimeter of the pool 120 by attaching the edge of the net 105 to the anchor members 130. Next, the end of the support cable 180 is secured to the support anchor 185. Thereafter, the tension apparatus 200 is positioned at the pool and attached to an anchor support 170. A cable 230 of the tension apparatus 200 is attached to the tension cable 125. Subsequently, the tension apparatus 200 is actuated to pull the end of the tension cable 125 to a point proximate the tension anchor 190 to allow the tension cable 125 to be manually attached to the tension anchor 190. At the same time, the circular shape formed between the pulleys 115 of the central tensioning system 110 is reduced, thereby causing the central tensioning system 110 to systematically tension the net 105. After the tension cable 125 is secured to the tension anchor 190, a lock member 140 on the tension cable may be attached to the lock anchor 135. The lock member 140 may be configured as a key and lock arrangement. It should be understood, however, that the lock member 140 may be any type of lock, without departing from principles of the present invention.

Figure 2:
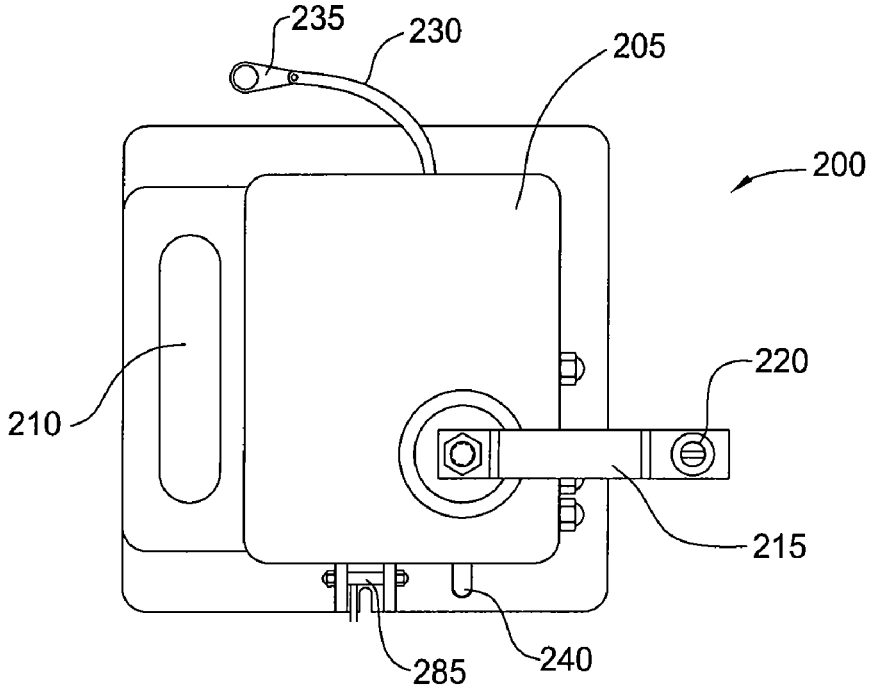
FIG. 2 illustrates a top view of the tension apparatus in accordance with the present invention.

FIG. 2 illustrates a top view of the tension apparatus 200. As shown, the tension apparatus 200 includes a housing 205 with a handle 210 formed therein. The tension apparatus 200 further includes a rotatable top arm 215 with a knob 220 at an end thereof. The top arm 215 or a lever arrangement is configured to be rotated relative to the housing 205 in a clockwise or a counter clockwise manner depending on the operation of the tension apparatus 200. Although the tension apparatus 200 shows a top arm for supplying rotational energy to the tension apparatus, it should be noted that any type of mechanical means or electrical means, such as a motor, may be used to supply rotational energy to the tension apparatus without departing from principles of the present invention.

The tension apparatus 200 also includes a cable 230 with a connection member 235 at an end thereof. The connection member 235 is used to attach the tension apparatus 200 to the tension cable (not shown). The tension apparatus 200 also includes a connector 285 for securing the tension apparatus 200 to the anchor support (not shown).

Figure 3:
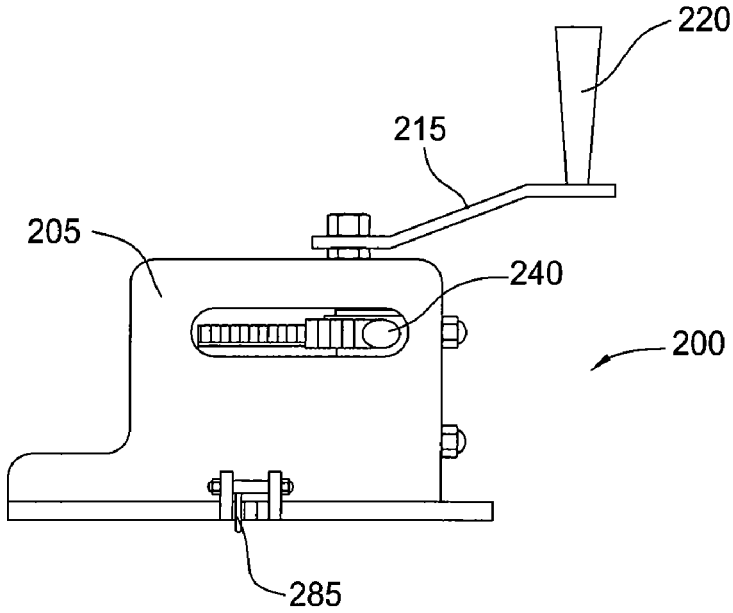
FIG. 3 illustrates a side view of the tension apparatus in accordance with the present invention.

FIG. 3 illustrates a side view of the tension apparatus 200. As shown, the tension apparatus 200 further includes a movable side arm 240 that is configured to selectively control the direction of movement of the cable 230. The side arm 240 is movable between a first position and a second position. When the arm 240 is in the first position, the rotation of the top arm 215 causes the cable 230 and the connection member 235 to move toward the housing 205. The first position is typically used when the tension apparatus 200 is employed to pull the tension cable toward the tension anchor as discussed in FIG. 1. When the arm 240 is in the second position, the cable 230 and the connection member 235 are free to move away from the housing 205. The second position is used when the cable 230 is being extended in order to allow the connector 235 to be attached to the tension cable.

Figure 5:
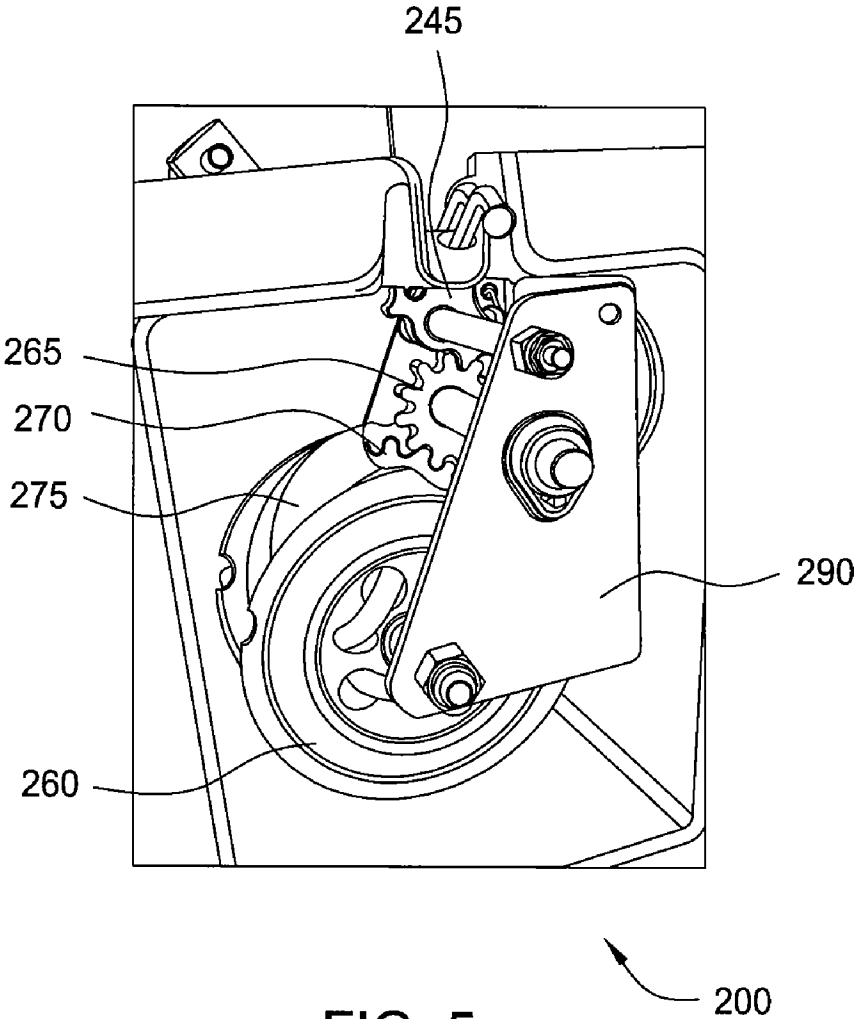
FIG. 5 illustrates an enlarged bottom perspective view of the tension apparatus in accordance with the present invention.
Figure 4:
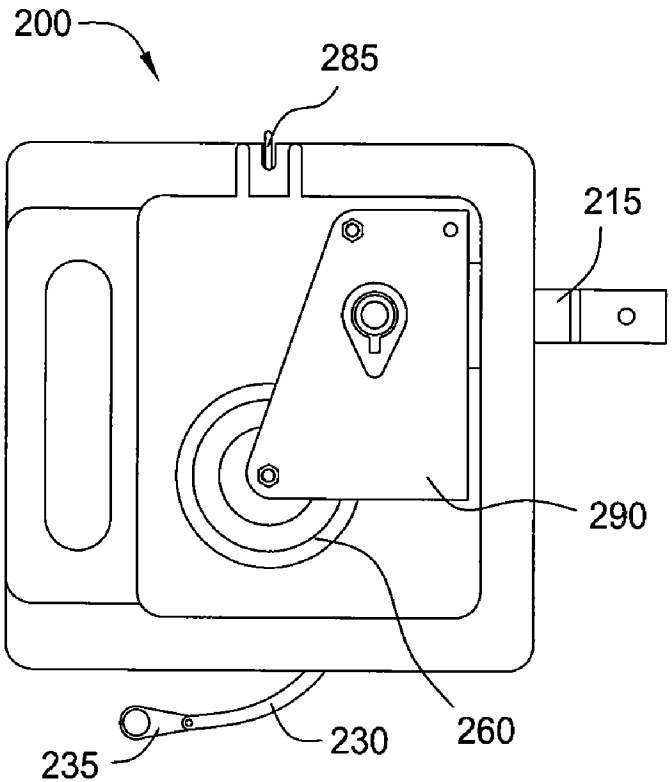
FIG. 4 illustrates a bottom view of the tension apparatus in accordance with the present invention.

FIG. 4 illustrates a bottom view of the tension apparatus 200 and FIG. 5 is an enlarged bottom prospective view of the tension apparatus 200. As shown, the tension apparatus 200 includes a spool 260 for holding the cable 230. The spool 260 is supported in the housing 205 via plate 290. As illustrated, the spool 260 is mounted in a horizontal plane relative to the top of the housing 205. Disposed around the spool 260 is a containment member 275 that is configured to contain the cable 230 on the spool 260 and ensure that the cable 230 does not tangle as the cable 230 is wrapped on the spool 260. Generally, the containment member 275 is made from a plastic material. Attached to an end of the spool 260 is a gear 270.

The arm 240 includes an engagement member 245 proximate an end thereof. The engagement member 245 is configured to selectively engage a gear 265 with the gear 270 on the spool 260. For instance, when the arm 240 is in the first position the engagement member 245 causes the gears 265, 270 to engage, thereby allowing the cable 230 to wrap around the spool 260 as the arm 215 is rotated. When the arm 240 is in the second position, the engagement member 245 allows the gears 265, 270 to disengage, thereby permitting the gear 270 and the spool 260 to rotate freely to allow the cable 230 to unwrap from the spool 260.

After the net 105 is tensioned by utilizing the tension apparatus 200 and the central tensioning system 110, the tension cable 125 may be secured in place by connecting the lock member 140 to the lock anchor 135. Thereafter, a sensor 155 may be employed as a pool safety device for detecting and alerting a user that an object, such as a child, has come in contact with the net 105. The sensor 155 includes circuitry for detecting movement in the net 105 that is generated by the object contacting the net 105. In other words, when the object contacts any part of the net 105, the object causes a vibration in the net and the vibration is translated through the tensioned braids of the net 105 to the sensor 155. The sensor 155 receives the vibrational signal and then operates to transmit a signal through a transmitter (not shown) to a receiver 150.

The sensor 155 can be any type of water resistant sensor capable of detecting movement, like vibration, such as a sensor having a mercury switch. Generally, mercury switches consist of a mercury filled tube with electrodes at each end. When the tube is tilted, the mercury flows to either end cutting off the circuit on one end while opening it on the other side. For instance, the mercury switch could be an open circuit when it is at rest, but becomes a short circuit when it is moved.

The sensor 155 may also be a vibration sensor. Generally, vibration sensors are sensors for measuring, displaying, and analyzing linear velocity, displacement, and proximity, or acceleration. They can be used on a stand-alone basis, or in conjunction with a data acquisition system. Vibration sensors are available in many forms. For instance, the vibration sensor may be raw sensing elements, packaged transducers, or as a sensor system or instrument incorporating features such as totalizing, local or remote display, and data recording. These devices work on many operating principles. The most common types of vibration sensors are piezoelectric, capacitance, null-balance, strain gage, resonance beam, piezoresistive, and magnetic induction. An alternative to traditional vibration sensors is one manufactured using MEMS technology, a micro-machining technology that allows for a much smaller device and thus package design.

The sensor 155 is operatively connected to the net 105 proximate the central tensioning system 110 so that its sensitivity to movement at any place on the net is maximized. It should be understood, however, that any number of sensors may be employed at various places on the pool net, without departing from principles of the invention. The sensor 155 may be connected to the net 105 by various connection means, such as a clip member. Typically, the sensor 155 is powered by an internal power supply, such as a battery. Alternatively, the sensor may be powered by an external power source connected to the sensor 155 via a cable (not shown).

The sensor 155 is constructed with an internal transmitter (not shown) to transmit a signal to the remote receiver 150. The signal may be transmitted in a wireless manner, whereby the sensor 155 broadcasts the signal through the air to the receiver 150. In another embodiment, an external transmitter (not shown) may be employed between the sensor 155 and the receiver 150. Generally, the transmitter is a device that sends a signal to the receiver 150 after the sensor 155 has been actuated. Typically, the transmitter is connected to the sensor 155 via a wire (not shown), such as marine wire. The wire may be embedded in the braids of the net 105 or as a separate wire operatively attached to the net 105. In either case, the sensor 155 sends the signal through the wire to the transmitter and then the transmitter sends the signal to the receiver 150 in a wireless format or through another wire (not shown). Typically, the transmitter houses the power supply for the sensor 155.

Upon signal reception from either the sensor 155 or the transmitter, the receiver 150 broadcasts an audible signal, such as a voice message, to indicate the object has contacted the net 105. The receiver 150 may be configured to broadcast different audible signals based upon the signal reception from either the sensor 155 or the transmitter. Although the sensor 155 has been described in relation to a pool, the principles of the present invention are equally applicable to a mesh pool cover or a solid pool cover. For example, a cover having a pool safety system could be attached to the perimeter of a pool and the cover could be tensioned by a means well known in the art. Thereafter, any foreign object that contacts the cover could cause the cover to vibrate and the vibration could be translated through the cover to a sensor. Upon reception of the vibration, the sensor could transmit a signal to a transmitter or directly to a receiver in a similar manner as described above. In turn, the receiver could broadcast an audible warning, such as a voice message, to indicate the object has contacted the cover.

While the foregoing is directed to embodiments of the present invention, other and further embodiments of the invention may be devised without departing from the basic scope thereof, and the scope thereof is determined by the claims that follow.

The invention claimed is:

1. An apparatus for applying a tension to a pool net, the apparatus comprising:

a pool net;

a housing having a top and a bottom;

a first gear and a second gear, wherein a face of each gear is substantially parallel to a plane of the top of the housing;

a rotatable member attached to the second gear for supplying rotational energy to the second gear;

a spool member operatively attached to the first gear; and a cable at least partially wrapped around the spool member, the cable having a connector selectively connected to a plurality of pulleys disposed in a central region of the pool net.

2. The apparatus of claim 1, further including an engagement member for selectively engaging the first and the second gears, the engagement member movable between a first and a second position.

3. The apparatus of claim 2, wherein the engagement member in the first position causes the gears to engage, thereby allowing the cable to wrap around the spool member upon rotation of the rotatable member.

4. The apparatus of claim 2, wherein the engagement member in the second position causes gears to disengage, thereby allowing the cable to unwrap from the spool.

5. The apparatus of claim 1, wherein the rotatable member is a lever arrangement.

6. The apparatus of claim 1, wherein the rotatable member is a motor.

7. The apparatus of claim 1, further including an anchoring connection attached to the housing, the anchoring connection configured to anchor the apparatus proximate the pool net.

8. The apparatus of claim 1, further including a handle member formed in the bottom of the housing.

9. An apparatus for use in tensioning a net, the apparatus comprising:

a pool net;

a housing having a top, a bottom and at least a first side and a second side;

a spool arrangement disposed in the housing;

a lever member for supplying rotational energy to the spool arrangement;

a side arm extending from the first side of the housing, the side arm configured to selectively engage the lever member and the spool arrangement, the side arm movable between a first position where the lever member and the spool arrangement are engaged and a second position where the lever member and the spool arrangement are disengaged; and a cable extending from the second side of the housing, the cable at least partially wrapped around the spool arrangement, the cable having a connector selectively connected to a plurality of pulleys disposed in a central region of the net.

10. The apparatus of claim 9, further including an anchor connection attached to the housing and configured to anchor the apparatus proximate the net.

11. The apparatus of claim 1, further comprising a containment member configured to contain the cable on the spool and to substantially prevent the cable from tangling as the cable is wrapped on the spool.

12. The apparatus of claim 9, further comprising a containment member operatively attached proximate the spool arrangement, wherein the containment member is configured to substantially prevent the cable from tangling as the cable is wrapped on the spool arrangement.

13. The apparatus of claim 9, wherein the lever member is disposed on the top of the housing and the lever member includes a portion that is substantially parallel to a plane of the top of the housing.

14. The apparatus of claim 9, wherein the first side of the housing is opposite the second side of the housing.

* * * * *